US007916357B2

(12) United States Patent
Sugiyama et al.

(10) Patent No.: US 7,916,357 B2
(45) Date of Patent: Mar. 29, 2011

(54) IMAGE READING APPARATUS

(75) Inventors: Kazuhide Sugiyama, Yokohama (JP); Masashi Shimamura, Kodama (JP)

(73) Assignee: Canon Denshi Kabushiki Kaisha, Saitama-ken (JP)

( * ) Notice: Subject to any disclaimer, the term of this patent is extended or adjusted under 35 U.S.C. 154(b) by 1493 days.

(21) Appl. No.: 11/118,424

(22) Filed: May 2, 2005

(65) Prior Publication Data

US 2005/0254103 A1 Nov. 17, 2005

(30) Foreign Application Priority Data

May 13, 2004 (JP) ..... 2004-143161

(51) Int. Cl.
*H04N 1/40* (2006.01)

(52) U.S. Cl. ..... 358/474

(58) Field of Classification Search ..... 358/1.1, 358/1.15, 474, 500, 505, 403, 449, 408
See application file for complete search history.

(56) References Cited

FOREIGN PATENT DOCUMENTS

| | | | |
|---|---|---|---|
| JP | 58-137857 | | 8/1983 |
| JP | 58137857 | * | 8/1983 |
| JP | 10-190938 | | 7/1998 |
| JP | 10190938 | * | 7/1998 |
| JP | 2000-115452 | | 4/2000 |

OTHER PUBLICATIONS

Konuki Kazuhiko, image reader and image recorde, Jul. 21, 1998, English translation.*
English translation for JP10190938, Jul. 1998.*
English translation for JP58137857, Aug. 1983.*

* cited by examiner

*Primary Examiner* — King Y Poon
*Assistant Examiner* — Iriana Cruz
(74) *Attorney, Agent, or Firm* — Fitzpatrick, Cella, Harper & Scinto

(57) ABSTRACT

An image reading apparatus for reading the image surface of a sheet material brought into close contact with the image reading surface of an image reading unit while passing the sheet material through an image reading gap formed between the sheet conveying surface of a sheet conveying guide and the image reading surface, including a holding member for holding the image reading unit for movement in a direction to change the width of the image reading gap, an upstream roller pair having a first roller member displaceable in accordance with the thickness of the sheet material, and for nipping and conveying the sheet material into the image reading gap, and a downstream roller pair having a second roller member displaceable in accordance with the thickness of the sheet material, and for nipping and conveying the sheet material out of the image reading gap, wherein the image reading unit changes the width of the image reading gap on the basis of the displacement of at least one of the first roller member and the second roller member.

10 Claims, 10 Drawing Sheets

IMAGE READING APPARATUS

BACKGROUND OF THE INVENTION

1. Field of the Invention

The invention relates to an image reading apparatus for reading an image while conveying a sheet material.

2. Description of Related Art

Usually an image reading apparatus of a type which reads the image surface of a sheet material while conveying the sheet material uses a close contact type image sensor as reading means, from the viewpoints of space and cost.

However, a lens used in the close contact type image sensor has a depth of field as small as 0.2-0.3 mm. Therefore, in a case where a sheet material cannot be held in the depth of field, that is, in a case where the sheet material cannot be brought into close contact with a focusing position (image reading surface) provided on a reading glass surface, blur occurs to a read image.

So, generally, as in an image reading apparatus 140 shown in FIG. 7 of the accompanying drawings, a transparent image reading surface 145 is attached to a reading portion housing 141, and a light source 144, a lens 143 and a light receiving element 142 are provided in the interior of the housing. When an image surface on the upper surface side of a sheet material S is to be read, a platen roller 246 mounted on the fore end of an arm member 148 is biased in the direction indicated by the arrow by a tension spring 147 and the image surface of the sheet material S is urged against the image reading surface 145. Thereby, the sheet material S is kept so as not to separate from the image reading surface 145 by a prescribed amount or greater.

Also, in Japanese Patent Application Laid-open No. H10-190938, as shown in FIG. 8 of the accompanying drawings, driven rollers 131 and 132 are provided on the upstream side and the downstream side, respectively, of a reading portion housing 141, and these are pressed against conveying rollers 121 and 122, respectively, by compression springs 170. Thereby, a sheet material S is brought into close contact with a sheet conveying guide 11 so as to bring the image surface of the sheet material S into close contact with an image reading surface.

Also, in Japanese Patent Application Laid-open No. 2000-115452, as shown in FIG. 9 of the accompanying drawings, a crooked conveying path P for a sheet material S is constituted by two reading portion housings 141. Thereby, the sheet material S conveyed through the conveying path P may be normally brought into close contact with image reading surfaces 145.

Now, there is a desire to well read, by an image reading apparatus, a laminate-processed, rigid card having a thickness of 0.3 mm or greater such as a driver's license heretofore read by a flat bed scanner.

However, in the above-described image reading apparatus constructed on the premise that the sheet material is thin paper, a sheet material having a great thickness is conveyed with a rush while widening the gap between an image reading surface and a platen roller or an original plate and may therefore injure the image reading surface. If an injury occurs to the image reading surface, a streak will occur to a read image.

Likewise, in the image reading apparatus 140 shown in FIG. 8, the sheet material S widens the gap between a sheet conveying surface 103 and an image reading surface 145 and therefore, an injury occurs to the image reading surface 145 and a streak occurs to a read image. Further, provision is made of an upstream roller pair (a conveying roller 121 and a driven roller 131) and a downstream roller pair (a conveying roller 122 and a driven roller 132) and therefore, when the sheet material S is engaged with one roller pair alone and when the sheet material S is engaged with both roller pairs, the posture of the reading portion housing 141 changes. Therefore, blur occurs to the read image.

Also, in the image reading apparatus shown in FIG. 9, the conveying path P is crooked and therefore, if the sheet material S is thick or high in rigidity, this sheet material is not flexed and may therefore be caught by the conveying path to thereby cause jam (sheet jamming).

As a construction which does not injure the reading surface, as shown in FIG. 10 of the accompanying drawings, there is also a method whereby conveying guide surfaces 141*d* and 141*e* provided before and behind an image reading surface 145 are a little protruded downwardly from the image reading surface 145.

In this method, however, if the sheet material S is a hard card or the like, the abrasion of the conveying guide surfaces 141*d* and 141*e* will be promoted. Also, if the sheet material S is a thin sheet material, jam will occur.

SUMMARY OF THE INVENTION

So, the present invention has as an object thereof to provide an image reading apparatus which can well read thin and thick sheet materials without involving the occurrence of jam and the promotion of the abrasion of parts and moreover, is free of the occurrence of a streak or blur to a read image.

In order to achieve the above object, the present invention provides an image reading apparatus for reading the image surface of a sheet material brought into close contact with the image reading surface of an image reading unit while passing the sheet material through an image reading gap formed between the sheet conveying surface of a sheet conveying guide and the image reading surface, the image reading apparatus comprising:

a holding member for holding the image reading unit for movement in a direction to change the width of the image reading gap;

an upstream roller pair having a first roller member displaceable in accordance with the thickness of the sheet material, and for nipping and conveying the sheet material into the image reading gap; and a downstream roller pair having a second roller member displaceable in accordance with the thickness of the sheet material, and for nipping and conveying the sheet material out of the image reading gap, wherein the image reading unit changes the width of the image reading gap on the basis of the displacement of at least one of the first roller member and the second roller member.

Also, the present invention provides an image reading apparatus for reading the image surface of a sheet material brought into close contact with the image reading surface of an image reading unit while passing the sheet material through an image reading gap formed between the sheet conveying surface of a sheet conveying guide and the image reading surface, the image reading apparatus comprising:

a holding member for holding the sheet conveying guide for movement in a direction to change the width of the image reading gap;

an urging member for urging the sheet conveying guide in a direction to narrow the image reading gap;

an upstream roller pair having a first roller member displaceable in accordance with the thickness of the sheet material, and for nipping and conveying the sheet material into the image reading gap; and a downstream roller pair having a second roller member displaceable in accordance with the thickness of the sheet material, and for nipping and conveying the sheet material out of the image reading gap, wherein the sheet conveying guide changes the width of the image reading gap on the basis of the displacement of at least one of the first roller member and the second roller member.

Other objects and features of the present invention will become apparent from the following detailed description and the accompanying drawings.

DETAILED DESCRIPTION OF THE PREFERRED EMBODIMENTS

Figure 1:
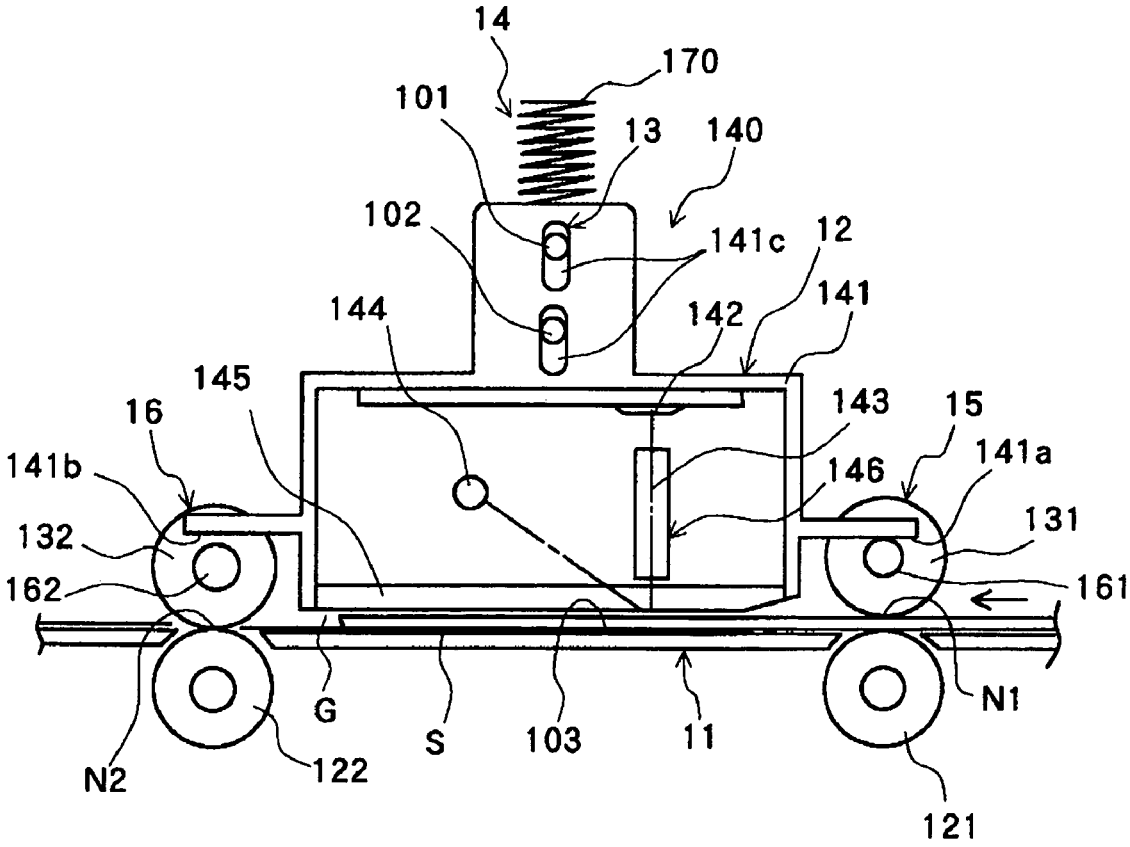
FIG. 1 is a longitudinal cross-sectional view schematically showing the construction of an image reading apparatus according to Embodiment 1.

Some embodiments of the present invention will hereinafter be described with reference to the drawings. In the drawings, the same reference characters designate members similar in construction or action, and the duplicate description of these is suitably omitted.

Embodiment 1

Figure 2:
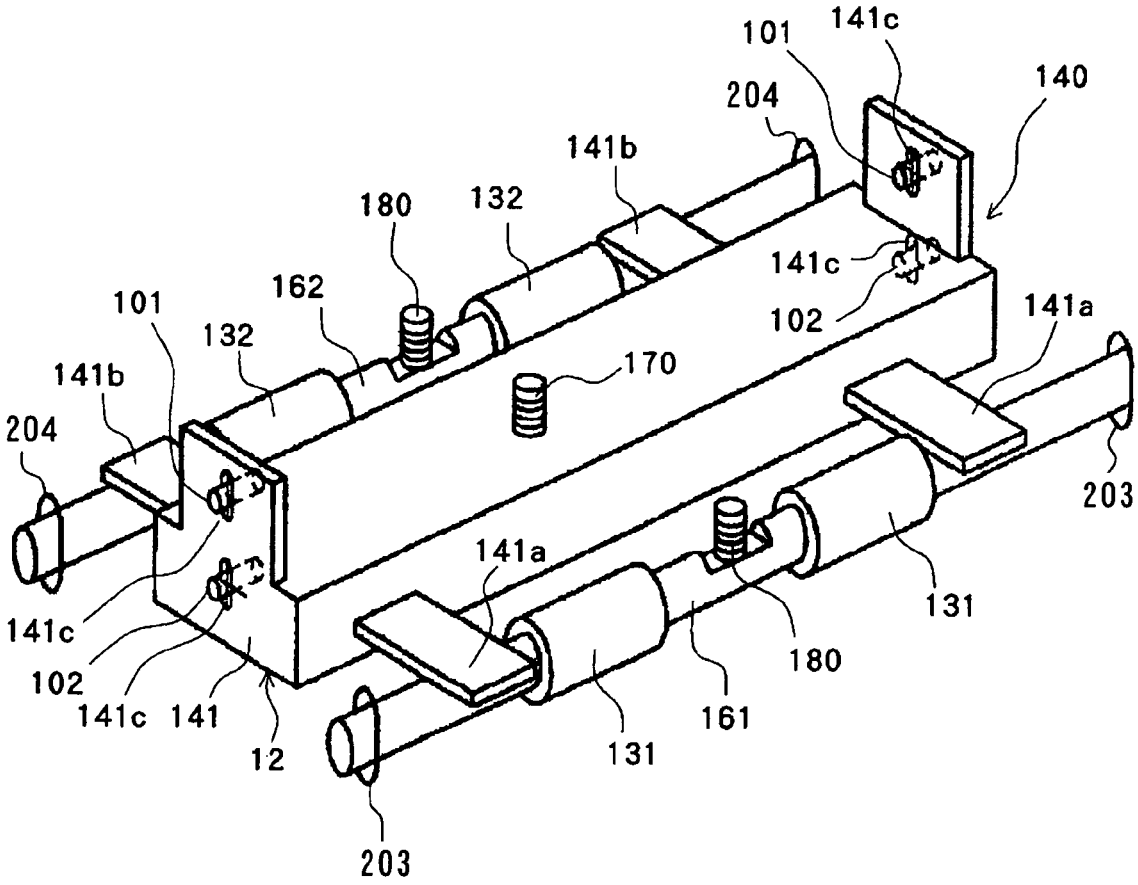
FIG. 2 is a perspective view schematically showing the construction of the image reading apparatus according to Embodiment 1.

FIGS. 1 and 2 show an image reading apparatus to which the present invention can be applied. FIG. 1 is a longitudinal cross-sectional view of the image reading apparatus taken in a direction along the conveying direction of a sheet material S, and FIG. 2 is a perspective view of the image reading apparatus as it is seen obliquely from above it.

The image reading apparatus 140 shown in FIGS. 1 and 2 is provided with a sheet conveying guide 11, an image reading unit 12, a holding member 13, an urging member 14, an upstream roller pair 15 and a downstream roller pair 16.

The sheet conveying guide 11 has its surface adjacent to the image reading unit 12 formed into a flat surface which provides a sheet conveying surface 103 for the sheet material conveyed in the direction indicated by the arrow. In the present embodiment, the sheet conveying surface 103 is horizontally disposed.

The image reading unit 12 has a reading portion housing 141, an image reading sensor 146 and an image reading surface 145. Of these, the entire image reading sensor 146 is fixedly disposed inside the reading portion housing 141. The image reading sensor 146 has a light source 144 for applying light to the image surface of the sheet material S brought into close contact with the image reading surface 145, a lens 143 for imaging reflected light from the image surface of the sheet material S, and a light receiving element 142 for converting the light imaged by the lens 143 into an electrical signal. The image reading surface 145 is attached to the lower portion of the reading portion housing 141 so as to be parallel to the sheet conveying surface 103 of the above-described sheet conveying guide 11. A thin-plate-shaped image reading gap G is formed between the sheet conveying surface 103 and the image reading surface 145. Design is made such that as will be described later, the sheet material S which is the object of image reading is conveyed into this image reading gap G by the upstream roller pair 15 and the image thereof is read with the image surface thereof brought into close contact with the image reading surface 145, and after the image reading, the sheet material S is conveyed out of the image reading gap G by the downstream roller pair 16.

In the present embodiment, a parallel moving mechanism is adopted as the holding member 13. The parallel moving mechanism is constituted by vertical guide holes (guide portions) 141*c* formed in the longitudinal opposite end portions of the above-described image reading unit, and salients 101 and 102 protruded from an image reading apparatus main body M (see FIG. 6) and engaged with these guide holes 141*c*. By this parallel moving mechanism, the image reading unit 12 is held for movement in a vertical direction, i.e., a direction to change the width (the vertical dimension in FIG. 1) of the above-described image reading gap G.

In the present embodiment, a compression spring 170 is used as the urging member 14. This compression spring 170 urges the image reading unit 12 in a direction to narrow the width of the image reading gap G.

The upstream roller pair 15 is constituted by a drive roller 121 and a driven roller 131 brought into contact therewith from above it, and a conveying nip N1 is formed between the two. The drive roller 121 is disposed so that the upper end thereof may slightly protrude from the sheet conveying surface 103 of the above-described sheet conveying guide 11, and is rotatably driven by a drive source (not shown) such as a motor. On the other hand, the driven roller 131 is rotatably supported by an unrotatably disposed roller shaft 161. The roller shaft 161 is vertically movably supported by a vertical guide hole 203 formed in the image reading apparatus main body M, and also is urged toward the drive roller 121 below it by a compression spring 180. Also, the roller shaft 161, near its longitudinal opposite end portions, is abutted against from below it by receiving portions 141*a* protruded from the above-described reading portion housing 141 toward an upstream side. Thereby, when the sheet material S is supplied to the conveying nip N1 in an abutting state, the driven roller 131 is displaced relative to the drive roller 121 in accordance with the thickness of the sheet S, and the roller shaft 161 is adapted to be displaced by the same amount as this amount of displacement to thereby raise the entire image reading unit 12 through the receiving portions 141*a*. Here, the vertical position of the lower end of the driven roller 131 is set so as to be substantially the same as the position of the underside of the image reading surface 145 of the image reading unit 12.

The downstream roller pair 16 is constituted by a drive roller 122 and a driven roller 132 brought into contact therewith from above it, and a conveying nip N2 is formed between the two. The drive roller 122 is disposed so that the upper end thereof may slightly protrude from the sheet conveying surface 103 of the above-described sheet conveying guide 11, and is rotatably driven by a drive source (not shown) such as a motor. On the other hand, the driven roller 132 is rotatably supported by an unrotatably disposed roller shaft 162. The roller shaft 162 is vertically movably supported by a vertical guide hole 204 formed in the image reading apparatus main body M, and also is urged toward the drive roller 122 below it by the compression spring 180. Also, the roller shaft 162, near its longitudinal opposite end portions, is abutted against from below it by receiving portions 141*b* protruded from the above-described reading portion housing 141 toward a downstream side. Thereby, when the sheet material S is supplied to the conveying nip N2 in an abutting state, the driven roller 132 is displaced relative to the drive roller 122 in accordance with the thickness of the sheet material S, and the roller shaft 162 is adapted to be displaced by the same amount as this amount of displacement to thereby raise the entire image reading unit 12 through the receiving portions 141*b*. Here, the vertical position of the lower end of the driven roller 132 is set so as to be substantially the same as the position of the under side of the image reading surface 145 of the image reading unit 12.

Description will now be made of the operation of the image reading apparatus 140 of the above-described construction.

When the leading edge of the sheet material S conveyed from the upstream side comes into the conveying nip N1 between the conveying roller 121 and driven roller 131 of the upstream roller pair 15, the driven roller 131 is upwardly moved (displaced) in accordance with the thickness of the sheet material S, and the roller shaft 161 is upwardly moved against the urging force of the compression spring 180 to thereby push up the receiving portions 141*a* of the reading portion housing 141. The image reading unit 12, as described above, is vertically movably held by the parallel moving mechanism and therefore, by the receiving portions 141*a* being pushed up, the entire image reading unit 12 is pushed up. Thereby, the image reading gap G between the sheet conveying surface 103 of the sheet conveying guide 11 and the image reading surface 145 is widened. At this time, the image reading gap G is widened by an amount corresponding to the amount of movement of the above-described driven roller 131, i.e., to the same width as the thickness of the sheet material S. Therefore, the sheet material conveyed into the image reading gap G by the upstream roller pair 15 is smoothly conveyed into the image reading gap G, and the image surface as the upper surface thereof is brought into close contact with the image reading surface 145 of the image reading unit 12. Accordingly, the image surface of the sheet material S is read well by the image reading sensor 146.

Next, the leading edge of the sheet material S of which the image surface has been read comes into the conveying nip N2 between the conveying roller 122 and driven roller 132 of the downstream roller pair 16. Thereby, the driven roller 132 is upwardly moved by an amount corresponding to the thickness of the sheet material S to thereby upwardly raise the roller shaft 162, and contacts with the reading portion housing 141*b* which is already located above, from below it. When the trailing edge of the sheet material S passes through the upstream conveying nip N1, the driven roller 131 is returned to its original position, i.e., the position in which it contacts with the drive roller 121, by the urging force of the compression spring 180. Again in this state, the image reading gap G keeps a state in which a suitable width substantially equal to the thickness of the sheet material S is kept because the image reading unit 12 is raised by the roller shaft 162 through the receiving portions 141*b*. This state continues until the trailing edge of the sheet material S completely passes through the conveying nip N2.

When the trailing edge of the sheet material S has completely passed through the downstream conveying nip N2, the driven roller 132 is returned to its original position, i.e., the position in which it contacts with the drive roller 121, by the urging force of the compression spring 180.

When the image surfaces of a plurality of sheet materials S are to be continuously read, the conveying timing of the sheet materials S can be set so that before the trailing edge of a preceding sheet material S completely passes through the downstream conveying nip N2, the leading edge of the succeeding sheet material S may come into the upstream conveying nip N1.

As described above, the width of the image reading gap G is always kept at a suitable width substantially equal to the thickness of the sheet material S during the time from after the leading edge of the sheet material S has come into the upstream conveying nip N1 until the trailing edge thereof completely passes through the downstream conveying nip N2. That is, the thickness of the sheet material S and the width of the image reading gap G correspond to 1:1 and therefore, the image surfaces of thin and thick sheet materials S can be read well without the occurrence of jam and the promotion of the abrasion of parts being involved and moreover, the image surfaces of the sheet materials S are brought into close contact with the image reading surface 145 and therefore, it never happens that a streak or blur occurs to the read image.

In addition, the same effect can be obtained if the urging member 14 is composed of a weight provided on the image reading unit 12 instead of the compression spring 170. In this case, urging member 14 urges the image reading unit 12 using the gravity of the weight.

Moreover, the urging member 14 may be composed of a weight formed integrally with the image reading unit 12 as a single entity.

Embodiment 2

Figure 3:
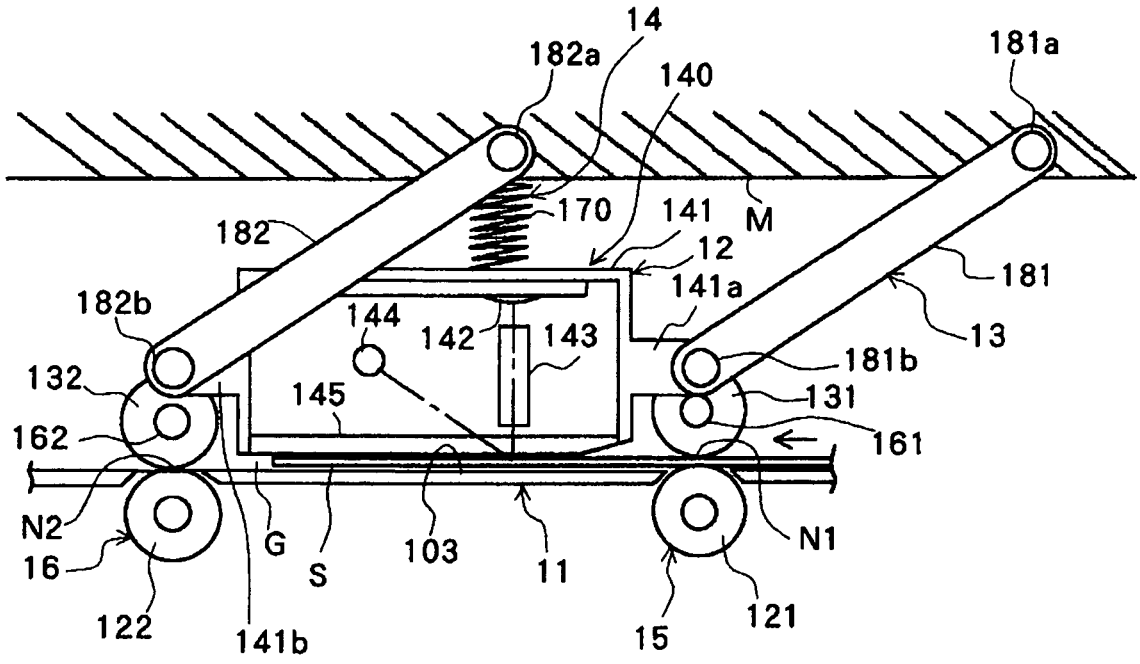
FIG. 3 is a longitudinal cross-sectional view schematically showing the construction of an image reading apparatus according to Embodiment 2.

In this embodiment shown in FIG. 3, a parallel link mechanism is adopted as a mechanism for moving the image reading unit 12 in a direction to change the width of the image reading gap G. Except the parallel link mechanism, the construction of this embodiment is similar to that of the above-described Embodiment 1 and therefore, the other members are given the same reference characters as in Embodiment 1 and the description thereof will be suitably omitted.

The parallel link mechanism supports the image reading unit 12 by two links 181 and 182 of the same shape. The upstream link 181 is obliquely disposed so that one end portion 181*a* thereof may be disposed above and the other end portion thereof may be located below downstream of the one end portion 181*a* with respect to the conveying direction of the sheet material S. The link 181 is such that the upstream end portion 181*a* thereof is pivotably supported by the image reading apparatus main body M and the other end portion 181*b* thereof is rotatably supported by the receiving portion 141*a* of the reading portion housing 141 of the image reading unit 12. The downstream link 182 is also similar to the upstream link 181. That is, the downstream link 182 is obliquely disposed so that one end portion 182*a* thereof may be disposed above and the other end portion thereof may be located below downstream of the one end portion 182*a* with respect to the conveying direction of the sheet material S. The link 182 is such that the upstream end portion 182*a* thereof is pivotally supported by the image reading apparatus main body M and the other end portion 182*b* thereof is rotatably supported by the receiving portion 141*b* of the reading portion housing 141 of the image reading unit 12. This parallel link mechanism forms a parallelogram by the end portions 181*a*, 181*b*, 182*a* and 182*b* of the above-described links 181 and 182. Accordingly, the image reading surface 145 of the image reading unit 12 disposed in parallelism to the sheet conveying surface 103 of the sheet conveying guide 11 is adapted to always keep parallelism when the image reading unit 12 is moved in a substantially vertical direction.

According to the present embodiment, in addition to the effect of the above-described Embodiment 1, the vertical movement of the image reading unit 12 is effected by the pivotal movements of the links 181 and 182 at their respective end portions 181*a*, 181*b*, 182*a* and 182*b* and therefore, the motion thereof can be made smooth, and the high durability of the holding mechanism can be obtained.

In addition, the same effect can be obtained if the urging member 14 is composed of a weight provided on the image reading unit 12 instead of the compression spring 170. In this case, urging member 14 urges the image reading unit 12 using the gravity of the weight.

Moreover, the urging member 14 may be composed of a weight formed integrally with the image reading unit 12 as a single entity.

Embodiment 3

Figure 4:
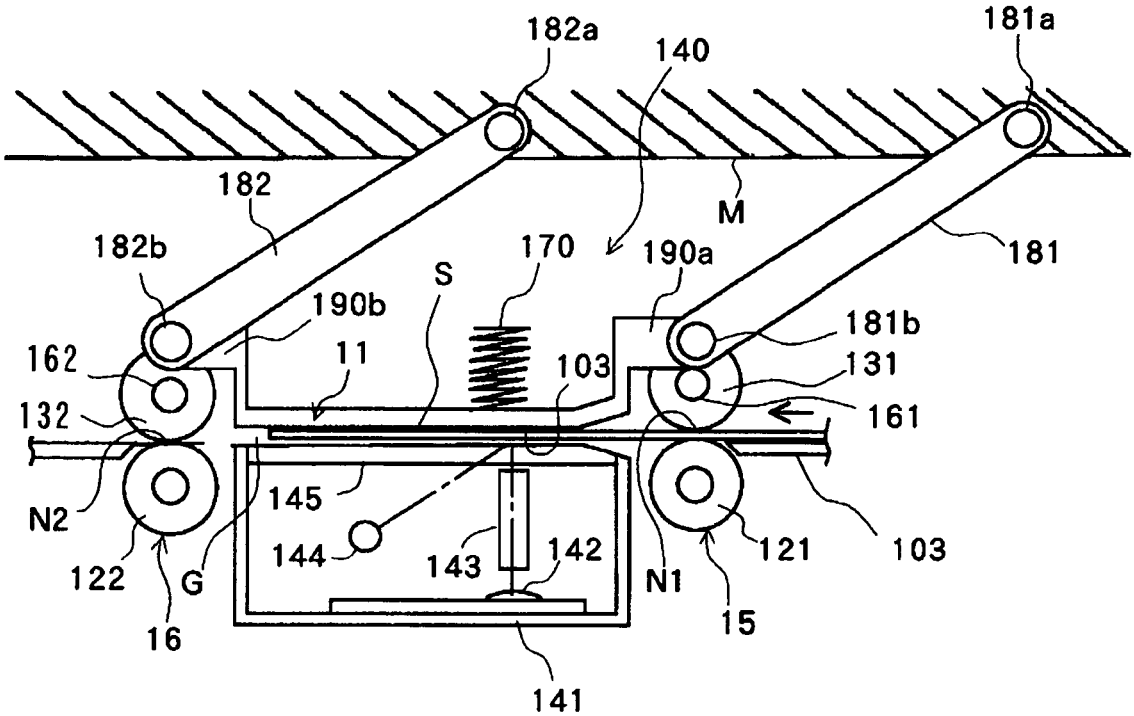
FIG. 4 is a longitudinal cross-sectional view schematically showing the construction of an image reading apparatus according to Embodiment 3.

FIG. 4 shows an image reading apparatus according to Embodiment 3. The image reading apparatus 140 shown in FIG. 4 is such that the image reading unit 12 is fixedly disposed below the image reading gap G and the sheet conveying guide 11 is substantially vertically movably disposed above the image reading gap G. The driven roller 131 (third roller member) of the upstream roller pair 15 has its roller shaft 161 upwardly brought into contact with the lower portion of a receiving portion 190*a* protruded to the upstream side from the sheet conveying guide 11. Also, the driven roller 132 (fourth roller member) of the downstream roller pair 16 has its roller shaft 162 upwardly brought into contact with the lower portion of a receiving portion 190*b* protruded to the downstream side from the sheet conveying guide 11. Further, in the present embodiment, the sheet conveying guide 11 is held by a parallel link mechanism similar to that in the above-described Embodiment 2.

In the present embodiment, design is made such that the sheet material S is conveyed through the image reading gap G with its image surface facing downwardly.

In the present embodiment of the above-described construction, design is made such that if the sheet material S is nipped by at least one of the conveying nip N1 of the upstream roller pair 15 and the conveying nip N2 of the downstream roller pair 16, the sheet conveying guide 11 is upwardly moved and the image reading gap G is kept at a width substantially equal to the thickness of the sheet material S.

According to the present embodiment, there can be achieved an effect similar to that of the above-described Embodiment 2.

In addition, the same effect can be obtained if the urging member 14 is composed of a weight provided on the sheet conveying guide 11 instead of the compression spring 170. In this case, urging member 14 urges the sheet conveying guide 11 using the gravity of the weight.

Moreover, the urging member 14 may be composed of a weight formed integrally with the sheet conveying guide 11 as a single entity.

Embodiment 4

Figure 5:
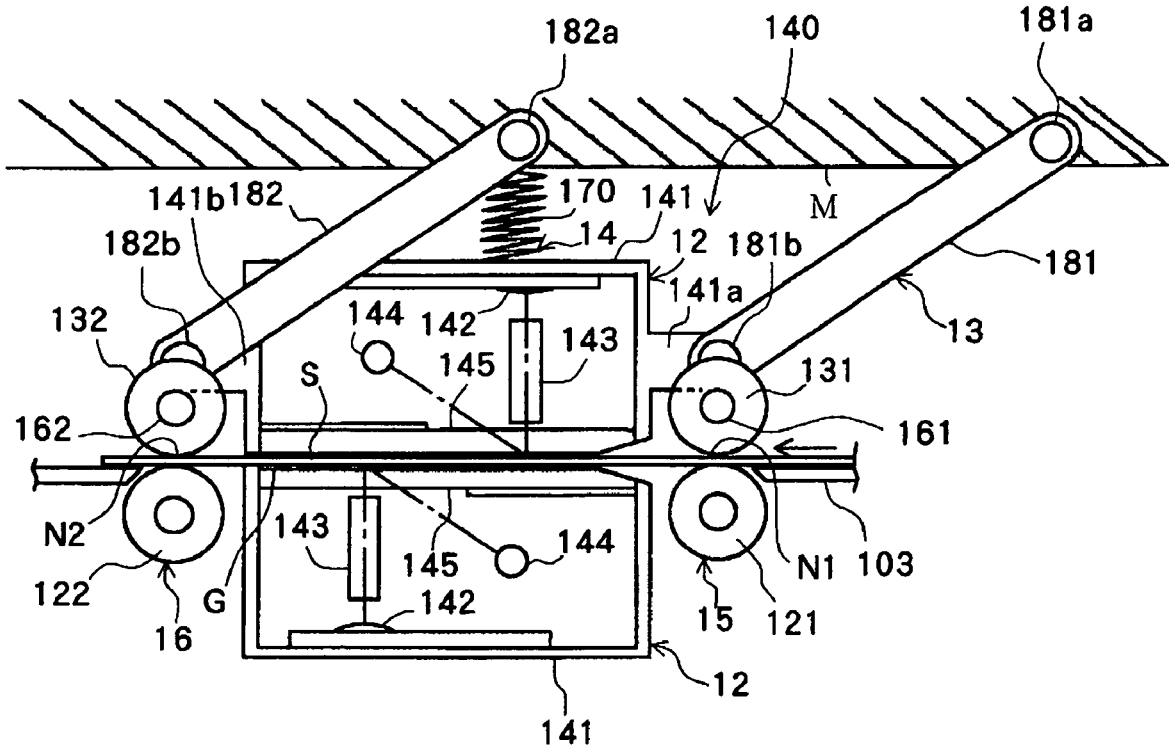
FIG. 5 is a longitudinal cross-sectional view schematically showing the construction of an image reading apparatus according to Embodiment 4.

FIG. 5 shows an image reading apparatus according to Embodiment 4. The image reading apparatus 140 shown in FIG. 5 comprises a combination of the image reading apparatus of Embodiment 2 shown in FIG. 3 and the image reading apparatus of Embodiment 3 shown in FIG. 4 so as to read images on the two sides of the sheet material S at a time.

That is, the image reading unit 12 shown in FIG. 4 is disposed below the image reading gap G, and the image reading unit 12 shown in FIG. 3 is disposed above the image reading gap G. In the present embodiment, the image reading surface 145 of one image reading unit serves also as the sheet conveying surface of the other reading unit.

According to the present embodiment, in addition to the effect of Embodiment 3, there is the effect that the images on the two sides of the sheet material S can be read at a time.

In addition, the same effect can be obtained if the urging member 14 is composed of a weight provided on the image reading unit 12 instead of the compression spring 170. In this case, urging member 14 urges the image reading unit 12 using the gravity of the weight.

Moreover, the urging member 14 may be composed of a weight formed integrally with the image reading unit 12 as a single entity.

Embodiment 5

Figure 6:
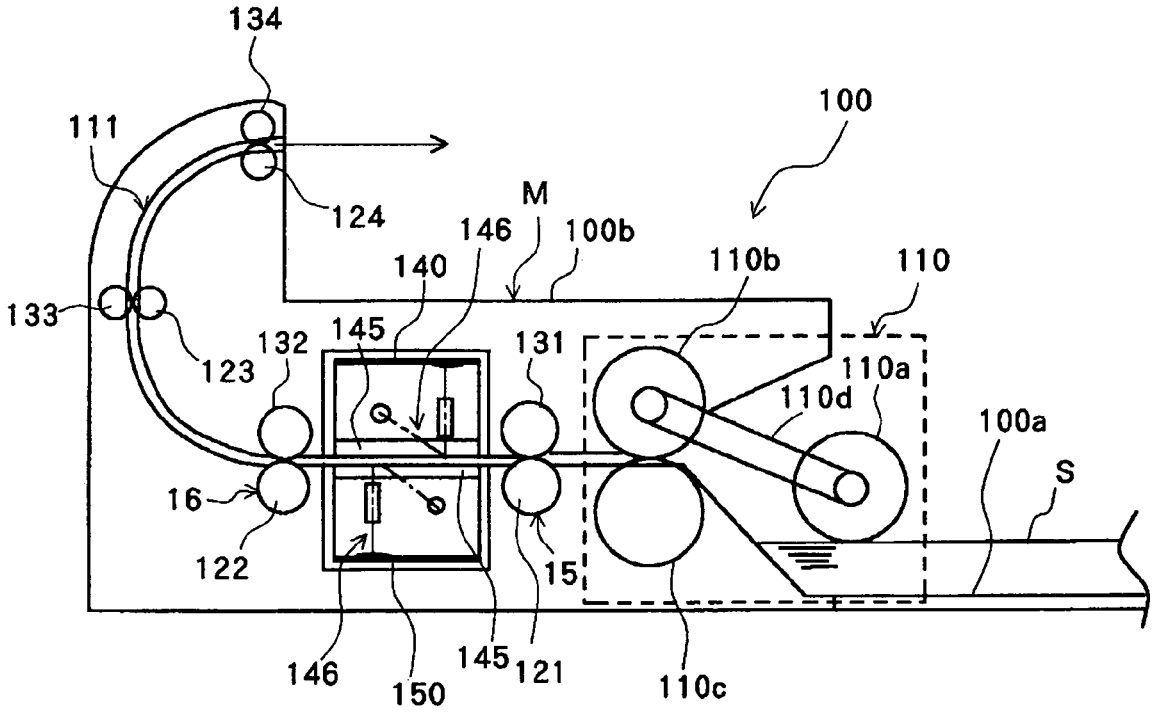
FIG. 6 is a longitudinal cross-sectional view schematically showing the construction of an automatic image reading apparatus according to Embodiment 5.
Figure 7:
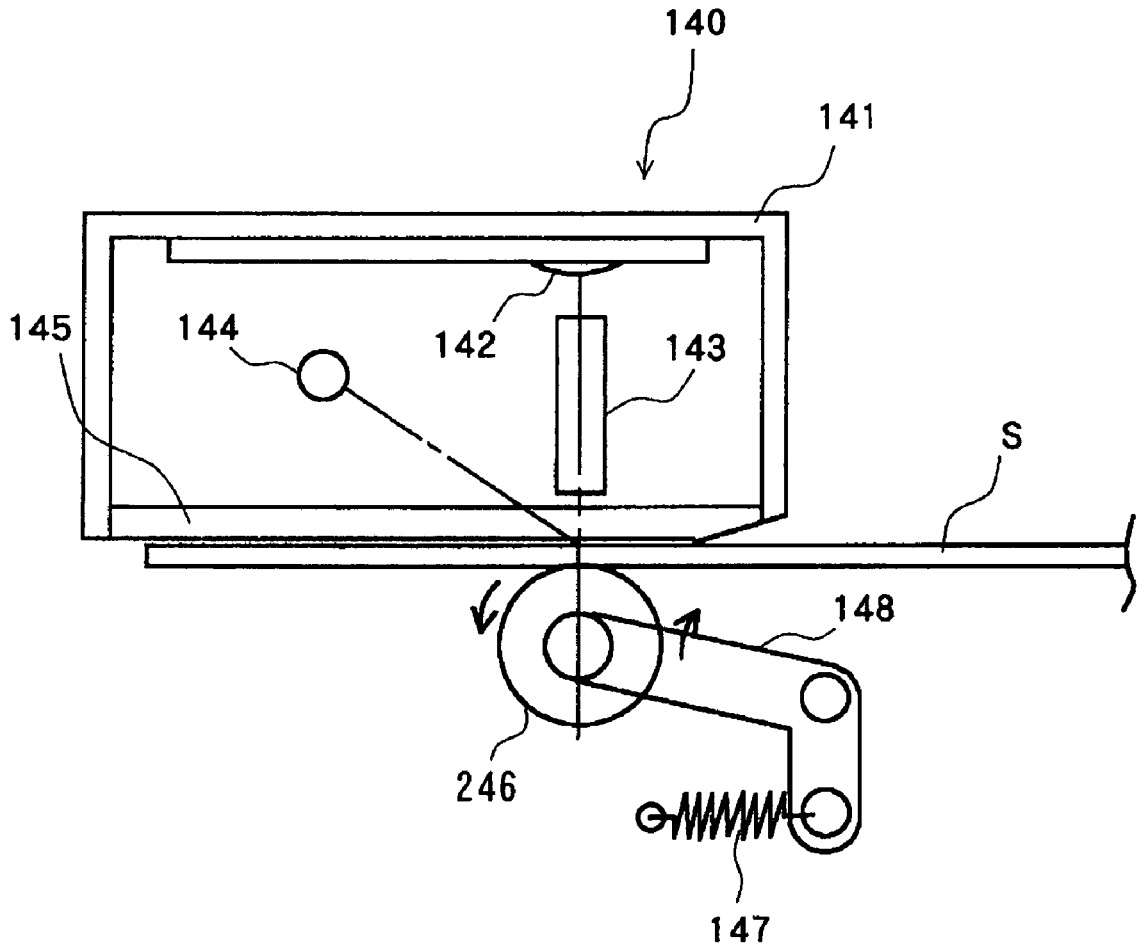
FIG. 7 is a longitudinal cross-sectional view schematically showing the construction of a conventional image reading apparatus.
Figure 8:
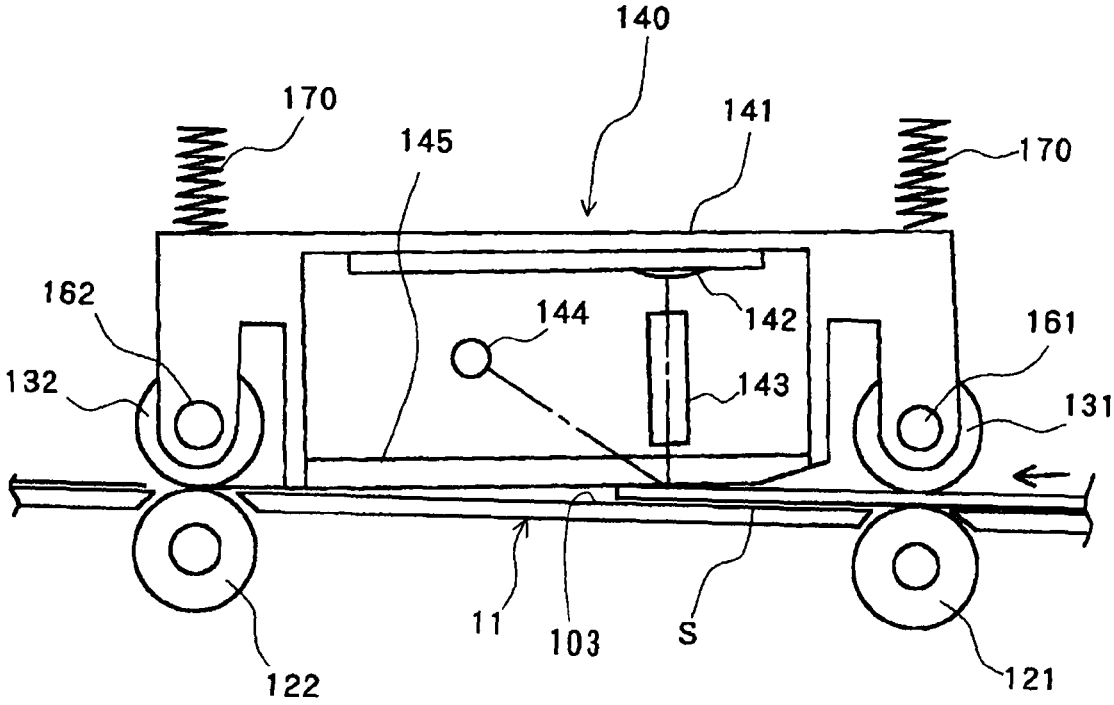
FIG. 8 is a longitudinal cross-sectional view schematically showing the construction of another conventional image reading apparatus.
Figure 9:
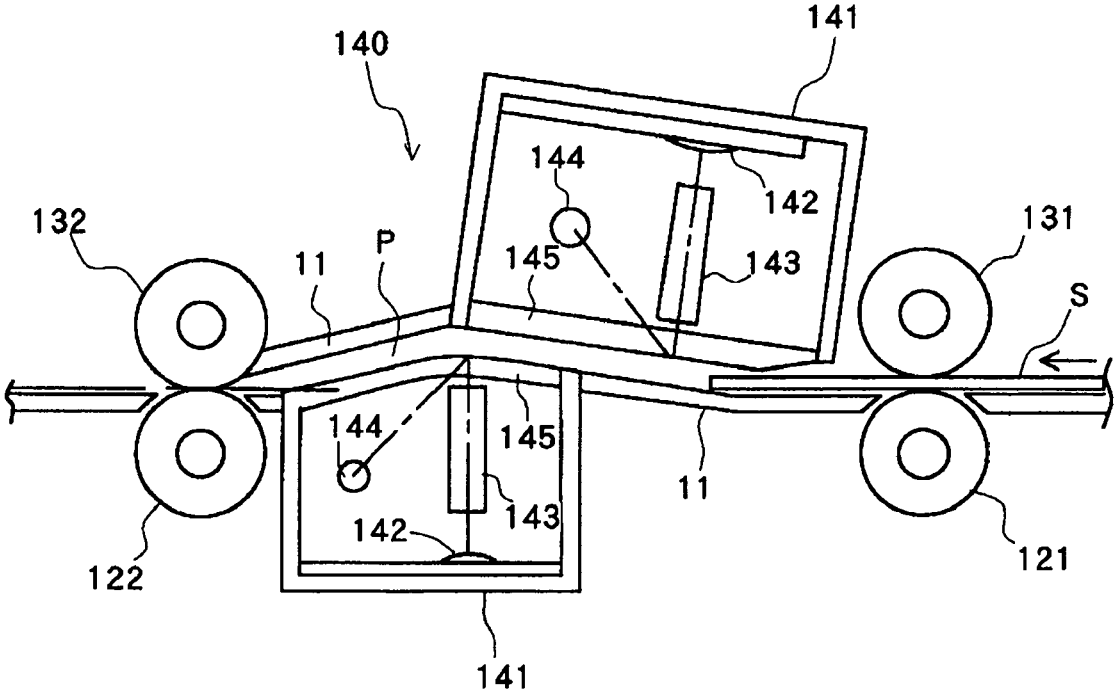
FIG. 9 is a longitudinal cross-sectional view schematically showing the construction of still another conventional image reading apparatus.
Figure 10:
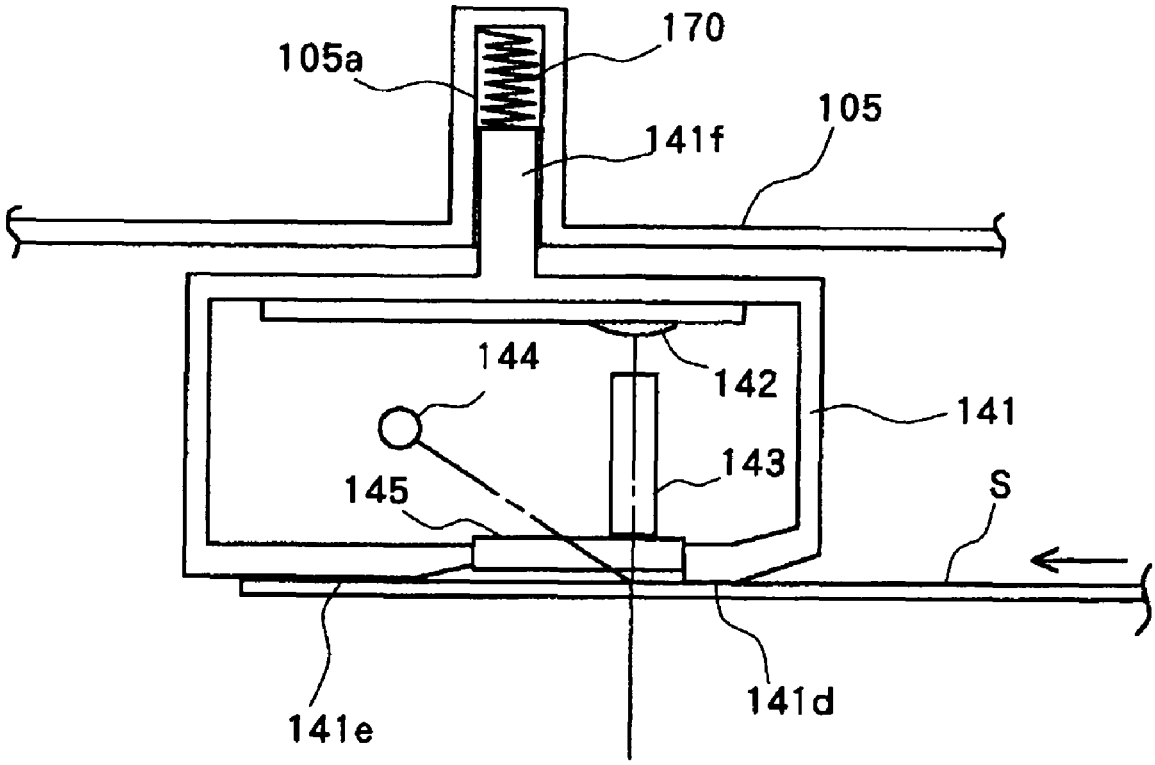
FIG. 10 is a longitudinal cross-sectional view schematically showing the construction of yet still another conventional image reading apparatus.

FIG. 6 shows the construction of an automatic image reading apparatus for automatically reading the image surface of the sheet material S by the utilization of the image reading apparatus 140 shown in FIG. 5.

The automatic image reading apparatus 100 is provided with a sheet stacking portion 100*a* in which a plurality of sheet materials S which are the object of image reading are contained in their stacked state, a feeding and conveying apparatus 110 for feeding and conveying the sheet materials S, an image reading apparatus 140 for reading the images of the sheet materials S supplied form this feeding and conveying apparatus 110, a discharging portion 111 for discharging the sheet materials S after image reading, and a discharged sheet stacking portion 100*b* in which the sheet materials S after image reading are contained in a stacked state. Of these, the feeding and conveying apparatus 110 has a sheet feeding roller 110*a* for supplying the sheet materials S one by one, a pair of separating and feeding rollers 110*b* and 110*c* for separating and supplying the sheet materials S fed by the sheet feeding roller 110*a* one by one, and an arm 110*d*. for rotatably and substantially vertically rockably supporting the above-described sheet feeding roller 110*a*. The image reading apparatus 140 is that shown in FIG. 5 which can read the images on the two sides of the sheet material S at a time, as described above. As the image reading apparatus, use may be made of that described in the foregoing Embodiment 1, 2 or 3.

The discharging portion 111 has a pair of conveying rollers 123 and 133 for conveying the sheet material S after image reading, and a pair of sheet discharging rollers 124 and 134 for discharging the sheet material S to the discharged sheet stacking portion 110*b*. Of these rollers, the rollers 123 and 124 are drive rollers, and the rollers 133 and 134 are driven rollers.

Description will now be made of the operation of the automatic image reading apparatus 100 of the above-described construction.

When the image reading operation is started, the plurality of sheet materials S stacked on the sheet stacking portion 100*a* are fed one by one by the feeding and conveying apparatus 110, and are conveyed into the image reading gap G between upper and lower image reading units 12 by the upstream roller pair 15. The sheet material S conveyed into the image reading gap G is conveyed with image surfaces formed on the two sides thereof being brought into close contact with the image reading surfaces 145 of the upper and lower image reading units 12 and at the same time, the image surfaces are read by image reading sensors 146. The sheet material S after image reading is conveyed out of the image reading gap G by the downstream roller pair 16*b*, and is further discharged onto the discharged sheet stacking portion 110*b* by the pair of conveying rollers 123 and 133 and the pair of sheet discharging rollers 124 and 134. Thereby the image reading operation for a sheet material S is completed. When the image surfaces of a plurality of sheet materials S are to be continuously read, the supply timing of the sheet materials S by the feeding and conveying apparatus 110 can be set so that as described above, before the trailing edge of the preceding sheet material S completely passes through the downstream conveying nip N2, the leading edge of the succeeding sheet material S may come into the upstream conveying nip N1.

Again in the automatic image reading apparatus 100 described above, an effect similar to that previously described can be achieved by using the above-described image reading apparatus 140.

According to the foregoing Embodiments 1 to 5, if the sheet material is nipped by at least one of the upstream roller pair and the downstream roller pair, the image reading apparatus or the sheet conveying guide is parallel-moved and the width of the image reading gap can be kept at a width corresponding to the thickness of the sheet material. Accordingly, the images of thin and thick sheet materials can be read well without the occurrence of jam and the promotion of the abrasion of parts being involved and moreover, it never happens that a streak or blur occurs to the read images.

This application claims priority from Japanese Patent Application No. 2004-143161 filed on May 13, 2004, which is hereby incorporated by reference herein.

What is claimed is:

1. An image reading apparatus for reading an image surface of a sheet material while passing the sheet material through an image reading gap formed between a sheet conveying surface of a sheet conveying guide and an image reading surface of an image reading unit, said image reading apparatus comprising:

a holding member for holding said image reading unit for movement in a direction to change a width of said image reading gap, while keeping a substantial parallelism of said image reading gap;

an upstream roller pair having a first roller member displaceable in accordance with a thickness of the sheet material, and for nipping and conveying the sheet material into said image reading gap;

a downstream roller pair having a second roller member displaceable in accordance with the thickness of the sheet material, and for nipping and conveying the sheet material out of said image reading gap;

an urging member for urging said first roller member toward the other roller member of said upstream roller pair; and a receiving portion provided on said image reading unit for receiving an upward displacement of said first roller member, to displace said image reading unit upward, wherein a displacement of at least one of said first roller member and said second roller member moves the image reading surface of said image reading unit, while the substantial parallelism between the image reading surface and the sheet conveying surface of the sheet conveying guide is kept by said holding member, to change the width of said image reading gap to a widened width, and wherein when a trailing edge of the sheet material has passed through a conveying nip of said upstream roller pair, said first roller member returns to its original position from its displaced position by said urging member independent of said receiving portion while said image reading gap is maintained at the widened width by the displacement of said second roller member.

2. An image reading apparatus according to claim 1, wherein said image reading unit changes the width of said image reading gap by the displacement of at least one of said first roller member and said second roller member.

3. An image reading apparatus according to claim 1, wherein the sheet conveying surface of said sheet conveying guide is disposed substantially in parallelism to a horizontal plane.

4. An image reading apparatus according to claim 1, wherein said first roller member and said second roller member are provided on an image reading unit side with respect to the sheet conveying surface, and said image reading apparatus further comprises at least two guide holes for guiding an upward displacement of a roller shaft of said first roller member and at least two other guide holes for guiding an upward displacement of a roller shaft of said second roller member.

5. An image reading apparatus according to claim 1, wherein a conveying timing of the sheet material is set so that before a trailing edge of a preceding sheet material completely passes through the nip of said second roller member, a leading edge of a succeeding sheet material comes into the nip of said first roller member.

6. An image reading apparatus according to claim 1, wherein said holding member is a parallel link mechanism.

7. An image reading apparatus according to claim 1, further comprising:

a second urging member for urging said image reading unit in a direction to narrow said image reading gap.

8. An image reading apparatus according to claim 7, wherein said second urging member is a spring.

9. An image reading apparatus according to claim 1, wherein said image reading unit further comprises a second receiving portion which receives the displacement of said second roller member, and said image reading unit changes the width of said image reading gap by the displacement of at least one of said first roller member and said second roller member.

10. An image reading apparatus according to claim 1, further comprising:

a first roller shaft provided in said first roller member; and a second roller shaft provided in said second roller member, wherein said image reading unit is displaced by a displacement of at least one of said first roller shaft and said second roller shaft.

* * * * *